US006598955B1

(12) United States Patent
Tee et al.

(10) Patent No.: US 6,598,955 B1
(45) Date of Patent: Jul. 29, 2003

(54) WIPING MECHANISM

(75) Inventors: Ah Chong Tee, Singapore (SG); Tzy Woei Chu, Singapore (SG); Bee Bee Ang, Singapore (SG)

(73) Assignee: Hewlett-Packard Development Company, LP, Houston, TX (US)

( * ) Notice: Subject to any disclaimer, the term of this patent is extended or adjusted under 35 U.S.C. 154(b) by 0 days.

(21) Appl. No.: 10/133,038

(22) Filed: Apr. 25, 2002

(51) Int. Cl.[7] ..... B41J 2/165
(52) U.S. Cl. ..... 347/33
(58) Field of Search ..... 347/33, 32, 29, 347/30, 35; 15/250.361, 256.5

(56) References Cited

U.S. PATENT DOCUMENTS 5,997,128 A * 12/1999 Lou et al. ..... 347/33
6,132,026 A 10/2000 Taylor ..... 347/32

* cited by examiner

*Primary Examiner*—Shih-Wen Hsieh
(74) *Attorney, Agent, or Firm*—Richard B. Main

(57) ABSTRACT

A method for wiping a printhead of an inkjet printing mechanism is provided. The printhead surface defines a printhead plane. In the method, firstly a wiper is moved substantially parallel to the printhead plane for wiping a first portion of the printhead surface. After the first portion of printhead surface is wiped, the wiper is moved away from the printhead plane for wiping a second portion of the printhead surface.

10 Claims, 3 Drawing Sheets

WIPING MECHANISM

BACKGROUND

This invention relates generally to inkjet printing mechanisms, and in particular to techniques for maintaining inkjet printhead at its optimal conditions.

Inkjet printing mechanisms use pens which shoot drops of liquid colorant, referred to generally herein as "ink," onto a media sheet. Each pen has a printhead formed with very small nozzles through which the ink drops are fired. To print an image, the printhead is propelled back and forth across the media sheet, shooting drops of ink in a desired pattern as it moves. The particular ink ejection mechanism within the printhead may take on a variety of different forms known to those skilled in the art, such as those using piezoelectric or thermal printhead technology.

To clean and protect the printhead, typically a "wiper assembly" mechanism is mounted within the housing of the printing mechanism so the printhead can be moved over the assembly for maintenance, specifically for wiping off ink residue as well as any paper dust or other debris that has collected on the printhead.

During the wiping process, there are risks that due to the wiping force, inks removed from the printhead may splash onto a pen-interconnect area where the printhead is electrically connected to the electrical components of the printing mechanism through conventional interconnects. The splash of ink onto the pen-interconnect area may cause an electrical short between the printhead and the interconnects and consequently a failure of the printhead.

Therefore, there is a need for an improved printhead wiping mechanism which reduces the risk of splashing ink onto undesired areas during a wiping process.

SUMMARY

According to an aspect of the present invention, a method for wiping a printhead of an inkjet printing mechanism is provided. The printhead surface defines a printhead plane. In the method, firstly a wiper is moved substantially parallel to the printhead plane for wiping a first portion of the printhead surface. After the first portion of printhead surface is wiped, the wiper is moved away from the printhead plane for wiping a second portion of the printhead surface.

According to a second aspect of the invention, a wiper assembly is provided for wiping a printhead of an inkjet printing mechanism having a chassis, with the printhead on a carriage supported by the chassis for moving to a wiping position, and with the printhead surface defining a printhead plane. The wiper assembly has a frame which defines a first and second guide tracks connected thereto. The first track extends substantially parallel to the printhead plane, while the second track extends away from the printhead plane. The wiper assembly also has a platform movable along the tracks and a wiper mounted on the platform for wiping the printhead when the printhead is in the wiping position.

According to a further aspect of the invention, an inkjet printing mechanism includes a chassis and a printhead on a carriage supported by the chassis for moving to a wiping position. The printhead surface defines a printhead plane. The inkjet printing mechanism further includes a wiper assembly that has a frame which defines a first and second guide tracks connected thereto. The first track extends substantially parallel to the printhead plane, while the second track extends away from the printhead plane. The wiper assembly also has a platform movable along the tracks and a wiper mounted on the platform for wiping the printhead when it is in the wiping position.

Other aspects and advantages of the invention will become apparent from the following detailed description, taken in conjunction with the accompanying drawings, which description illustrates by way of example the principles of the invention.

DETAILED DESCRIPTION

Figure 1:
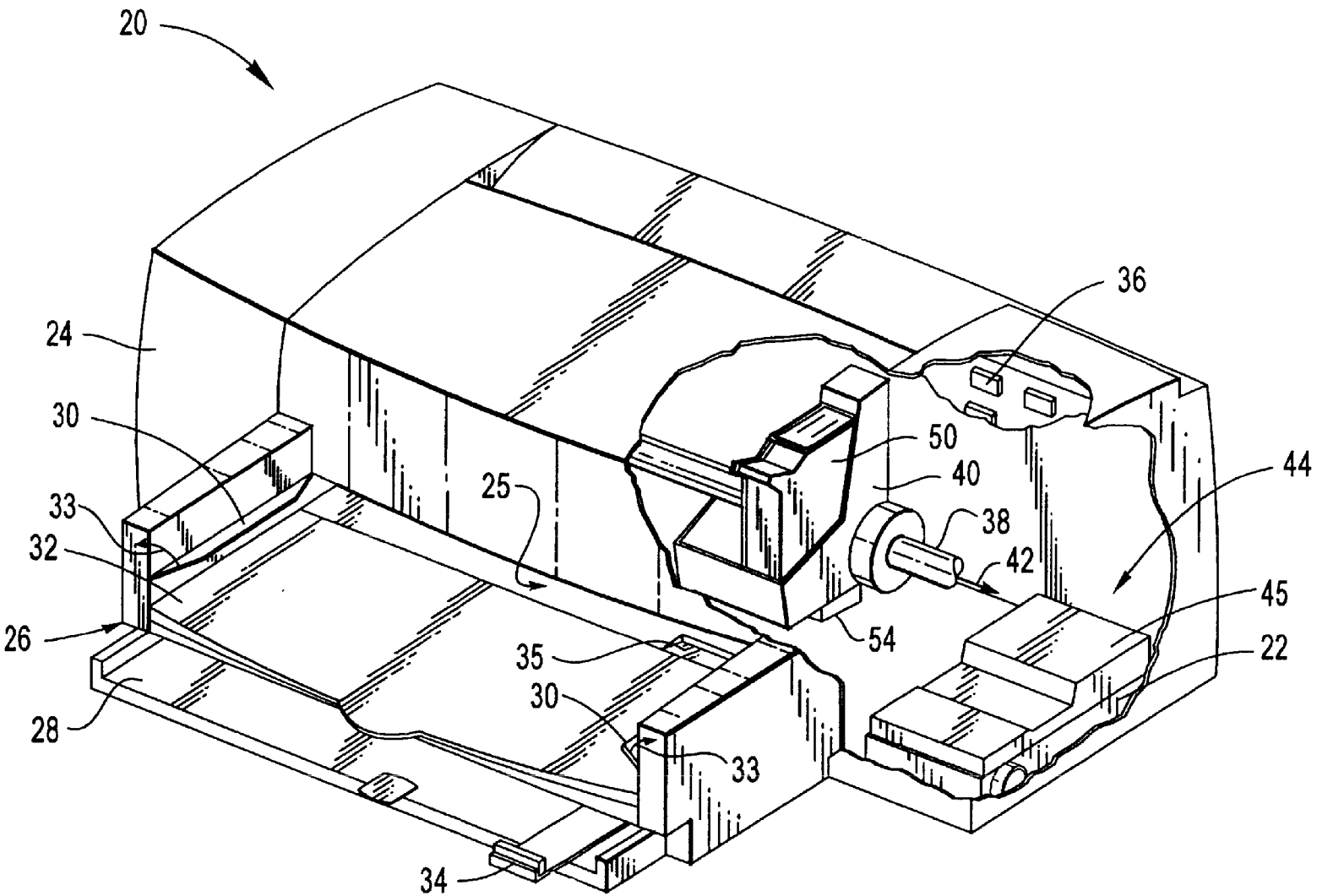
Figure 1 (Prior Art)
FIG. 1 is a fragmented, partially schematic, perspective view of one form of an inkjet printing mechanism in the prior art.

For convenience, the concepts of the present invention are illustrated in the environment of an inkjet printer 20, while it is understood that the present invention as illustrated by the exemplary embodiment can also be used in other inkjet printing mechanisms such as facsimile machines and copiers.

While it is apparent that the printer components may vary from model to model, the typical inkjet printer 20 includes a chassis 22 surrounded by a housing or casing enclosure 24. Sheets of print media for example paper are fed through a print zone 25 by an adaptive print media handling system 26. The print media handling system 26 has a feed tray 28 for storing sheets of paper before printing. After printing, the sheet then lands on a pair of retractable output drying wing members 30, shown extended to receive a printed sheet. The wings 30 momentarily hold the newly printed sheet above any previously printed sheets still drying in an output tray portion 32 before pivotally retracting to the sides, as shown by curved arrows 33, to drop the newly printed sheet into the output tray 32.

The printer 20 also has a printer controller, illustrated schematically as a microprocessor 36, that receives instructions from a host device, typically a computer, such as a personal computer (not shown).

A carriage guide rod 38 is supported by the chassis 22 to slidably support an inkjet carriage 40 for travel back and forth across the print zone 25 along a scanning axis 42 defined by the guide rod 38. To provide carriage positional feedback information to printer controller 36, an optical encoder reader may be mounted to carriage 40 to read an encoder strip extending along the path of carriage travel.

The carriage 40 is also propelled along guide rod 38 into a servicing region, as indicated generally by arrow 44, located within the interior of the casing 24. The servicing region 44 houses a service station 45, which may provide various conventional printhead servicing functions as generally understood in the art.

In the print zone 25, the media sheet receives ink from an inkjet cartridge 50 on the carriage. The cartridge 50 is also often called a "pen" by those in the art. The illustrated pen 50 includes a reservoir for storing a supply of ink. The pen 50 also has a printhead 54, which has an orifice plate with a plurality of nozzles formed therethrough in a manner well known to those skilled in the art. The illustrated printhead 54 is a thermal inkjet printhead, although other types of printheads may be used, such as piezoelectric printheads. The printhead 54 typically includes a substrate layer having a plurality of resistors which are associated with the nozzles. Upon energizing a selected resistor, a bubble of gas is formed to eject a droplet of ink from the nozzle and onto media in the print zone 25. The printhead resistors are selectively energized in response to enabling or firing command control signals. The control signals may be delivered by a conventional multi-conductor strip (not shown) from the controller 36 to the printhead carriage 40, and through conventional interconnects (partially shown as 58 in FIG. 2) between the carriage and the pen 50 to the printhead 54. In particular, the area where the interconnects between the carriage 40 and the pen 50 exist is defined as a pen-interconnect area 59 (see FIG. 2) for the purpose of this application.

Preferably, the outer surface of the orifice plate of the printhead 54 lies in a common printhead plane. This printhead plane may be used as a reference plane for establishing a desired media-to-printhead spacing, which is one important component of print quality. Furthermore, this printhead plane may also serve as a servicing reference plane, to which the various appliances of the service station 45 may be adjusted for optimum pen servicing. Proper pen servicing not only enhances print quality, but also prolongs pen life by maintaining the health of the printhead 54.

In the present application, only part of the pen servicing functions is discussed, namely, wiping of the printhead 54. It is understood that a wiping mechanism can be incorporated in the service station 45 as illustrated in U.S. Pat. No. 6,132,026, assigned to the present assignee, Hewlett-Packard Company. Alternatively, as shown in the exemplary embodiment of the present invention illustrated by FIGS. 2 and 3, the wiping mechanism can be separated from the service station 45 and mounted on the chassis 22 alone.

Figure 2:
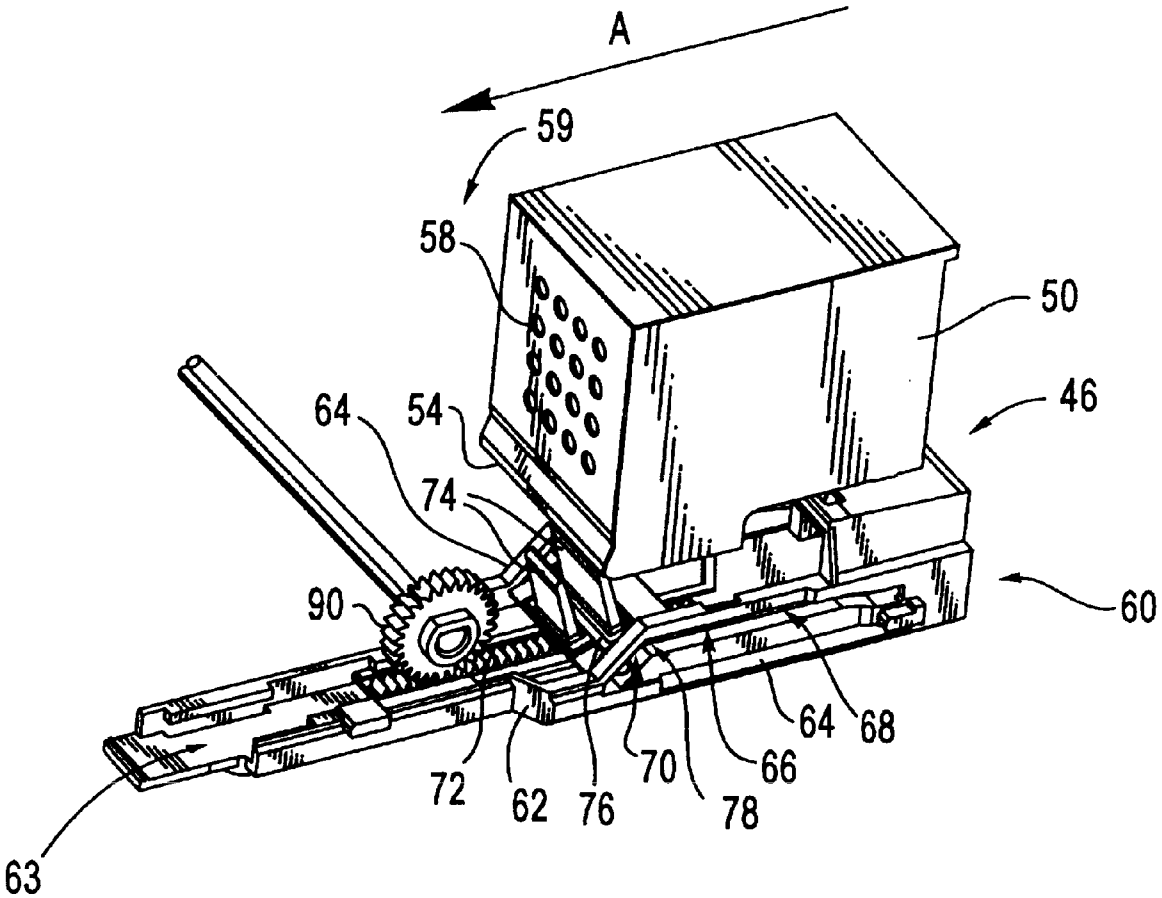
FIG. 2 is a perspective view illustrating an exemplary embodiment of the present invention of a wiper assembly that can be used in the printing mechanism of FIG. 1.

In FIG. 2, a wiper assembly 60 is mounted on the chassis 22 and beneath the pen 50 when the pen 50 is in a wiping region, as indicated generally by arrow 46, located within the interior of the casing 24. The wiper assembly 60 has a pair of flexible wiper blades 74 mounted on a platform 76 for wiping the printhead 54. The wiping occurs when a rack 72 connected to the platform 76 slides along a slot 63 defined within a base frame 62 of the wiper assembly. The rack is driven back and forth along the slot 63 by a rotatable wiper gear 90, which engages a plurality of engaging teeth on the rack 72. Further, the wiper gear 90 is rotated by a motor (not shown) in the printer through a gear train (not shown) therebetween as generally understood in the art. In addition, the slot 63 as well as the rack 72 extends in a direction substantially parallel to the direction in which the nozzles (not shown) of the printhead 54 are aligned as shown by arrow A in FIG. 2. Such a direction is substantially perpendicular to the scanning axis 42.

A pair of frame walls 64 respectively located at two sides of the base 62 project upward in the exemplary embodiment of the present invention and extend horizontally in a direction substantially parallel to the slot 63 as well as the printhead plane. Each wall 64 has an opening or a guide track 66 formed therein, and the platform 76 has two projections (see FIG. 3) at two respective sides for fitting into the guide tracks 66. In this way, the platform 76 is restricted to slide along the guide tracks 66 during the wiping process.

As shown in FIG. 2, the guide tracks 66 can be divided into two parts, a horizontal part 68 extending substantially parallel to the printhead plane and an incline part 70 extending away from the printhead plane. In the exemplary embodiment, the wiper assembly is located under the printhead 54, the horizontal part extends horizontally, and the incline part extends downward at a predetermined degree to the horizontal part 68. Such a degree is mainly determined by the requirements of the wiping force as well as by the availability of space in the casing 24.

In the exemplary embodiment, the two parts 68, 70 of the guide tracks are connected at a point 78 within a horizontal coverage of the printhead 54 and close to an end of the printhead adjacent to the pen-interconnect area 59. Furthermore, a forward stroke of a wiping process in the exemplary embodiment is generated as the wiper assembly moves from a position located at an end of the printhead away from the pen-interconnect area toward the end of the printhead adjacent to the pen-interconnect area, and vice versa.

Therefore, in the exemplary embodiment, the platform 76 firstly moves substantially parallel to the printhead plane and then moves downward along the incline part 70 in the forward stroke. In the backward stroke of the wiping process, the platform 76 firstly moves upward along the incline part 70 and then moves substantially parallel to the printhead plane along the horizontal part.

It is understood that the flexible wiper blades are bent over by the printhead during the wiping processes, and the interference between the wiper blades 74 and the printhead affects the wiping force exerted on the printhead 54. In the exemplary embodiment, when the wiper assembly moves along the horizontal part of the guide track, the wiper blades are bent to a certain extent and exert a desired wiping force on the printhead. When the platform travels along the incline part in the forward stroke, the wiper blades remain contact with the printhead for a short period for wiping the remaining part of the printhead surface. However, since the wiper blades 74 move away from the printhead plane when the platform 76 moves along the incline part 70 in the forward stroke, the interference between the wiper blades 74 and the printhead 54 is gradually reduced accordingly. As a result, the wiper blades 74 exert a reduced amount of wiping force on the remaining part of the printhead 54 as compared to when the platform moves along the horizontal part 68. Since the incline part 70 originates from the connection point 78 within the horizontal coverage of the printhead and is distanced from the pen-interconnect area 59, such a reduced wiping force consequently reduces the risk of splashing ink into the pen-interconnect area 59. In addition, the wiper blades 76 moving away from the printhead plane in the forward stroke would cause the ink removed to move in a direction away from the printhead. Such a direction of the ink movements would also help to reduce the risk discussed above.

The connection point 78 is designed such that in the forward stroke, the wiper blades 74 wipe a large portion of the nozzles in the printhead 54 when the platform 76 moves along the horizontal part. When the platform moves along the incline part 70 in the forward stroke, the wiper blades 74 wipe only the last few nozzles close to the pen-interconnect area 59. Therefore, the reduced amount of wiping force is only exerted on the last few nozzles in the forward stroke, and the diminished effect on the whole wiping is relatively negligible. Furthermore, in the backward stroke, the platform 76 climbs up the incline part of the guide track, and the wiper blades 74 wipe the orifice plate of the printhead from the beginning of its edge adjacent to the pen-interconnect area. In this way, the backward stroke of the wiping process compensates the reduced wiping force on the last few nozzles in the forward stroke as described above.

Figure 3:
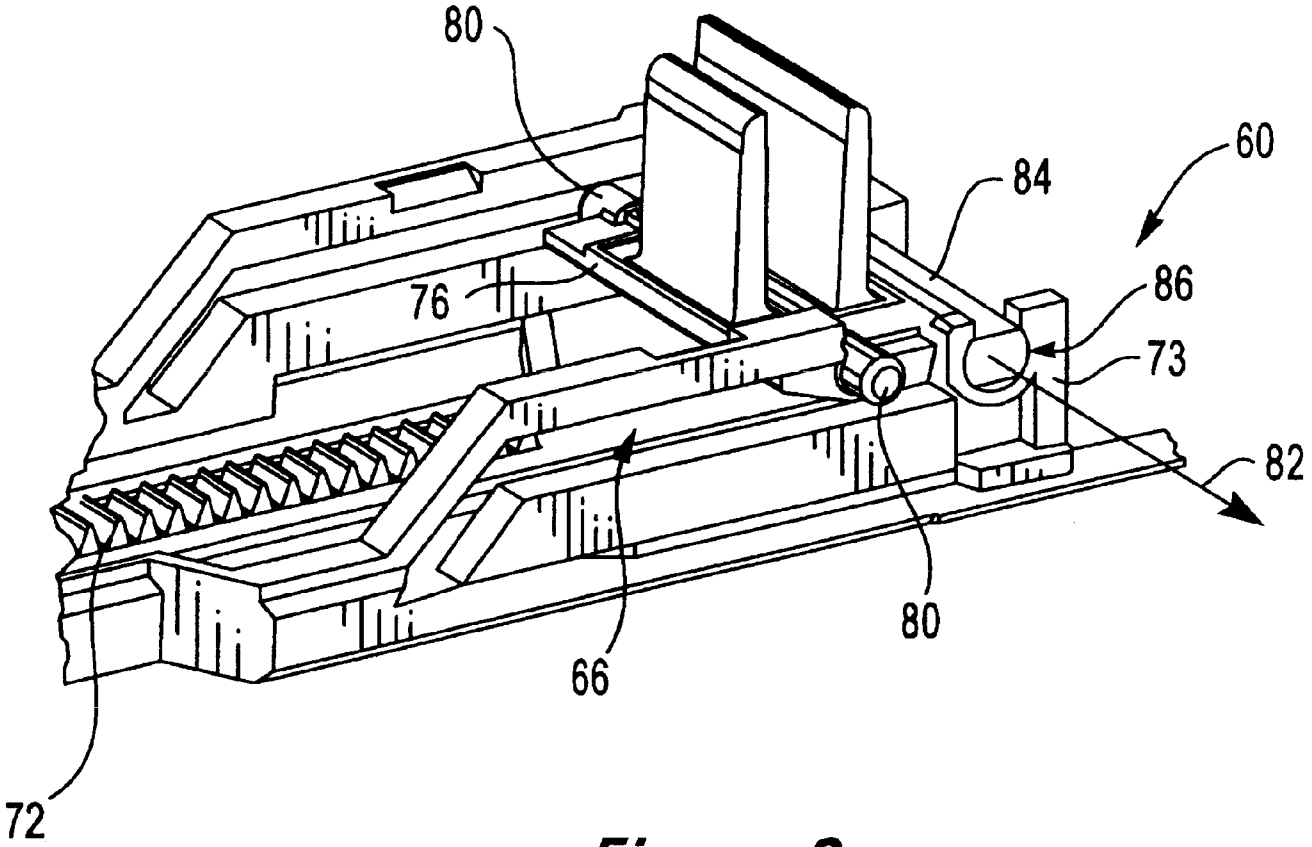
FIG. 3 is a perspective view illustrating in detail a portion of the wiper assembly of FIG. 2.

FIG. 3 illustrates in detail part of the wiper mechanism, with the wiper gear 90 removed. As shown, the rack 72 has a support 73, which extends upward and is mounted on the rack 72 at an end away from the wiper gear 90. A pivot arm 84 at an end of the platform 76 fits into a pivot slot 86 at an end of the support such that the platform 76 is rotatably mounted to the support 73. Furthermore, a pair of projections 80 at the two sides of the platform 76 fit into the guide track 66 such that the movements of the projections 80 as well as the platform 76 are restricted by the guide track 66.

When the rack 72 slides back and forth along the slot 63, the platform 76 moves accordingly as driven by the support 73. It is noted that the platform is rotatable in an upward or a downward direction about an axis 82 passing through the center of the pivot arm. Such a rotation of the platform about the axis 82 allows the projections 80 to move downward in the forward stroke and to move upward in the backward stroke when the projections 80 are on the incline part 70. As a result, the platform 76, as well as the wiper blades 74 thereon, moves away from the printhead plane when the projections 86 move along the incline part 70 of the guide track 66 in the forward stroke.

Alternatives can be made to the exemplary embodiment. For example, the incline part 70 can be in an arc shape instead of being straight as shown in FIGS. 2 and 3.

What is claimed is:

1. A method for wiping a printhead having a surface of an inkjet printing mechanism, wherein the printhead surface defines a printhead plane, the method comprising:

moving a wiper substantially parallel to the printhead plane for wiping a first portion of the printhead surface; and after wiping the first portion of the printhead surface, moving the wiper at a degree to the printhead plane for wiping a second portion of the printhead surface.

2. A method for wiping a printhead having a surface of an inkjet printing mechanism, wherein the printhead surface defines a printhead plane, the method comprising:

moving a wiper substantially parallel to the printhead plane for exerting a first amount of wiping force on the printhead to wipe a first portion of the printhead surface; and after wiping the first portion of the printhead surface, moving the wiper away from the printhead plane for exerting a reduced amount of wiping force on the printhead to wipe a second portion of the printhead surface.

3. The method of claim 1, further comprising:

driving inks removed from the printhead in a direction away from the printhead plane.

4. The method of claim 1, wherein the step of moving the wiper at a degree to the printhead plane includes varying said degree during wiping of the second portion of the printhead surface.

5. A wiper assembly for wiping a printhead having a surface in an inkjet printing mechanism having a chassis, with the printhead on a carriage supported by the chassis for moving to a wiping position, and with the printhead surface defining a printhead plane, the assembly comprising:

a frame which defines a first and second guide tracks connected thereto, wherein the first track extends substantially parallel to the printhead plane, and wherein the second track extends away from the printhead plane;

a platform movable along the tracks; and a wiper mounted on the platform for wiping the printhead when the printhead is in the wiping position.

6. The assembly of claim 5, wherein the first and second tracks are configured such that the wiper wipes a first portion of the printhead surface as the platform moves along the first track, and wipes a second portion of the printhead surface as the platform moves along the second track.

7. The assembly of claim 6, wherein the first and second tracks are configured such that the wiper exerts a first wiping force on the first portion of the printhead surface and a reduced wiping force on the second portion of the printhead surface.

8. The assembly of claim 5, further comprising a support slidable within the printing mechanism in a direction parallel to the printhead plane, wherein the platform is rotatably mounted to the support.

9. An inkjet printing mechanism, comprising:

a chassis;

a printhead having a surface on a carriage supported by the chassis for moving to a wiping position, the printhead surface defining a printhead plane; and a wiper assembly including a frame which defines a first and a second guide tracks connected thereto, wherein the first track extends substantially parallel to the printhead plane, and wherein the second track extends away from the printhead plane;

a platform movable along the tracks; and a wiper mounted on the platform for wiping the printhead when the printhead is in the wiping position.

10. A method for wiping a printhead having a surface of an inkjet printing mechanism, wherein the printhead surface defines a printhead plane, the method comprising:

moving a wiper in a first direction substantially parallel to the printhead plane for wiping a first portion of the printhead surface; and after wiping the first portion of the printhead surface, moving the wiper in the first direction while simultaneously rotating the wiper in a second direction about an axis for wiping a second portion of the printhead surface.

* * * * *